US011555592B1

(12) United States Patent
Lee

(10) Patent No.: US 11,555,592 B1
(45) Date of Patent: Jan. 17, 2023

(54) LAMP FOR VEHICLE AND VEHICLE INCLUDING THE SAME

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 17/806,783

(22) Filed: Jun. 14, 2022

(30) Foreign Application Priority Data

Jul. 28, 2021 (KR) ..... 10-2021-0099035

(51) Int. Cl.
*F21S 41/24* (2018.01)
*F21S 41/143* (2018.01)
*F21S 41/25* (2018.01)

(52) U.S. Cl.
CPC ..... *F21S 41/24* (2018.01); *F21S 41/143* (2018.01); *F21S 41/25* (2018.01)

(58) Field of Classification Search
None
See application file for complete search history.

(56) References Cited

U.S. PATENT DOCUMENTS

2009/0027911 A1* 1/2009 Misawa ..... F21V 7/0091 362/545
2019/0017675 A1* 1/2019 Suwa ..... F21S 41/24

* cited by examiner

*Primary Examiner* — Elmito Breval
(74) *Attorney, Agent, or Firm* — DLA Piper LLP (US)

(57) ABSTRACT

An embodiment of the present disclosure provides a lamp for a vehicle, the lamp including a plurality of light sources configured to form two or more types of light distribution patterns, and a light guide unit disposed at one side of the plurality of light sources and having a recessed region having a shape recessed upward in a lower portion of the light guide unit, in which the plurality of light sources includes a first light source disposed rearward of the light guide unit and configured to face a rear portion of the light guide unit, and a second light source disposed below the light guide unit and configured to face a lower portion of the light guide unit, in which the light guide unit includes a first light entering portion provided on a rear portion of the light guide unit and configured such that at least a part of light emitted from the first light source enters the first light entering portion, and a second light entering portion provided in the recessed region of the light guide unit and configured such that at least a part of light emitted from the second light source enters the second light entering portion, and in which the second light entering portion is positioned below a function division plane which is an imaginary plane connecting an uppermost end of the rear portion of the light guide unit and a lowermost end of a front portion of the light guide unit.

16 Claims, 5 Drawing Sheets

LAMP FOR VEHICLE AND VEHICLE INCLUDING THE SAME

CROSS-REFERENCE TO RELATED APPLICATION

This application claims priority to and the benefit of Korean Patent Application No. 10-2021-0099035 filed in the Korean Intellectual Property Office on Jul. 28, 2021, the entire contents of which are incorporated herein by reference.

TECHNICAL FIELD

The present disclosure relates to a lamp for a vehicle and a vehicle including the same.

BACKGROUND ART

Various types of lamps, which are classified depending on the functions thereof, are mounted in a vehicle. For example, a low beam lamp, a high beam lamp, and a daytime running light (DRL) lamp are mounted.

The high beam lamp may be mainly used to ensure a visual field up to a longer distance when there is no oncoming vehicle when the vehicle travels at night. The low beam lamp may be used to ensure an appropriate visual field of a driver without hindering a visual field of an oncoming vehicle when there is an oncoming vehicle. The DRL lamp is used to ensure a visual field of a driver and inform other vehicles of the position of the host vehicle on a rainy day or in a situation in which a visual range is short even during the daytime such as a situation in which the vehicle travels in a tunnel. In some countries, the DRL lamp needs to be installed mandatorily as an essential lamp in the vehicle.

FIG. 1 illustrates a structure of a low beam lamp and a structure of the DRL lamp in the related art. First, referring to FIG. 1A, in the low beam lamp in the related art, light emitted from an LED is reflected by a reflector, and then a part of the light is blocked by a shield, and another part of the light passes through an aspherical lens and exits to the outside, thereby forming a light distribution pattern. Meanwhile, referring to FIG. 1B, in the DRL lamp in the related art, light emitted from an LED passes through an optic and exits to the outside, thereby forming a light distribution pattern. As described above, the low beam lamp in the related art implements the low beam pattern by using the projection type optical system, and the DRL lamp implements the DRL pattern by using the primary optic. The low beam lamp and the DRL lamp have separate optical systems in accordance with the functions and types and implement different images.

However, since the above-mentioned structures in the related art use different light-emitting planes for the respective optical systems, there is a problem in that it is impossible to meet the consumer's various requirements in terms of the design of the vehicle at the time of turning on the lamps. In addition, since the optical systems need to be provided for the respective functions, there is inefficiency in manufacturing costs and time. Further, the optical systems occupy separate spaces, which causes an increase in overall volume of a headlamp.

SUMMARY

The present disclosure has been made in an effort to provide a lamp for a vehicle and a vehicle including the same, in which a single optical system is used to distribute a low beam pattern and a DRL pattern to the same light-emitting plane, which makes it possible to unify day and night lighting images of a lamp, implement a discriminative lamp design, improve spatial efficiency in the lamp, and reduce costs.

An exemplary embodiment of the present disclosure provides a lamp for a vehicle, the lamp including: a plurality of light sources configured to form two or more types of light distribution patterns; and a light guide unit disposed at one side of the plurality of light sources and having a recessed region having a shape recessed upward in a lower portion of the light guide unit, in which the plurality of light sources includes: a first light source disposed rearward of the light guide unit and configured to face a rear portion of the light guide unit; and a second light source disposed below the light guide unit and configured to face a lower portion of the light guide unit, in which the light guide unit includes: a first light entering portion provided on a rear portion of the light guide unit and configured such that at least a part of light emitted from the first light source enters the first light entering portion; and a second light entering portion provided in the recessed region of the light guide unit and configured such that at least a part of light emitted from the second light source enters the second light entering portion, and in which the second light entering portion is positioned below a function division plane which is an imaginary plane connecting an uppermost end of the rear portion of the light guide unit and a lowermost end of a front portion of the light guide unit.

At least a part of the light emitted from the first light source may pass through the first light entering portion, exit to the outside, and then form a first light distribution pattern, and at least a part of the light emitted from the second light source may pass through the second light entering portion, exit to the outside, and then form a second light distribution pattern.

The first light distribution pattern may be a low beam pattern, and the second light distribution pattern may be a DRL pattern.

The first light entering portion may be provided in the form of a curved surface convexly protruding toward a position disposed rearward of the light guide unit.

The light guide unit may further include: a first shield portion provided in the recessed region of the light guide unit and disposed rearward of the second light entering portion; and a cut-off portion extending in a direction from the first shield portion toward a front side of the light guide unit.

The first shield portion may be inclined upward in the direction toward the front side of the light guide unit, and a reflective layer may be formed on one surface of the first shield portion and block at least a part of the light emitted from the first light source.

The second light entering portion may be inclined downward in a direction toward a front side of the light guide unit.

The second light source may be provided within a width of the second light entering portion in a forward/rearward direction.

The light guide unit may be provided in the recessed region of the light guide unit and may further include a second shield portion extending in a direction from the second light entering portion toward a front side of the light guide unit.

The second shield portion may be positioned below the function division plane.

The second shield portion may be inclined upward in the direction toward the front side of the light guide unit, and a reflective layer may be formed on one surface of the second shield portion and block at least a part of the light emitted from the second light source.

The light guide unit may further include: a first light exiting portion provided on the front portion of the light guide unit and configured such that at least a part of the light entering through the first light entering portion exits the first light exiting portion; and a second light exiting portion provided on the front portion of the light guide unit and configured such that at least a part of the light entering through the second light entering portion exits the second light exiting portion.

The first light exiting portion and the second light exiting portion may have curved shapes convexly protruding toward a front side of the light guide unit and have aspherical lens shapes having different radii of curvature.

The second light exiting portion may be disposed above the first light exiting portion.

A lowermost end of the second light exiting portion may be coincident with an imaginary plane extending from the second light source and an uppermost end of the second shield portion or positioned below the imaginary plane extending from the second light source and the uppermost end of the second shield portion.

Another exemplary embodiment of the present disclosure provides a vehicle including: a lamp for a vehicle, in which the lamp for a vehicle includes: a plurality of light sources configured to form two or more types of light distribution patterns; and a light guide unit disposed at one side of the plurality of light sources and having a recessed region having a shape recessed upward in a lower portion of the light guide unit, in which the light sources include: a first light source disposed rearward of the light guide unit and configured to face a rear portion of the light guide unit; and a second light source disposed below the light guide unit and configured to face a lower portion of the light guide unit, in which the light guide unit includes: a first light entering portion provided on a rear portion of the light guide unit and configured such that at least a part of light emitted from the first light source enters the first light entering portion; and a second light entering portion provided in the recessed region of the light guide unit and configured such that at least a part of light emitted from the second light source enters the second light entering portion, and in which the second light entering portion is positioned below a function division plane which is an imaginary plane connecting an uppermost end of the rear portion of the light guide unit and a lowermost end of a front portion of the light guide unit.

According to the present disclosure, it is possible to achieve the function of the lamp and the spatial efficiency by implementing the low beam pattern and the DRL pattern by using the single optical system and discriminate the design by unifying the day and night lighting images of the lamp, thereby improving the identity of the vehicle.

DETAILED DESCRIPTION

Figure 1A:
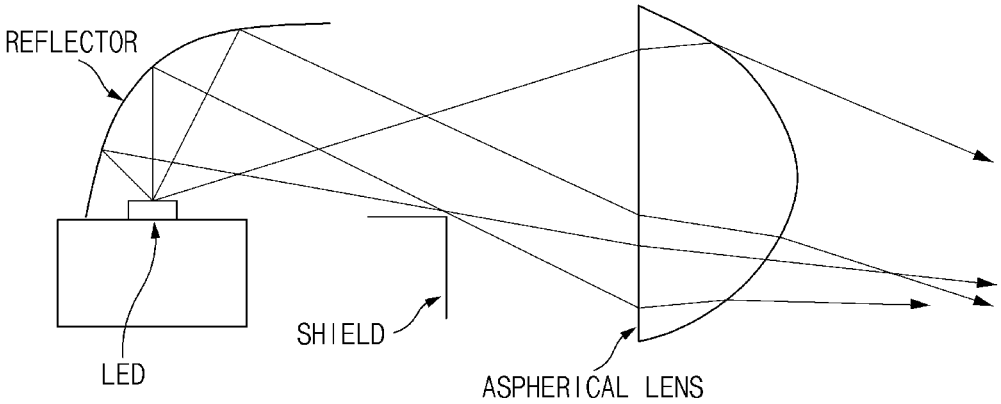
FIGS. 1A and 1B are views illustrating a structure of a low beam lamp, a structure of a DRL lamp, and a route of light in the related art.
Figure 1B:
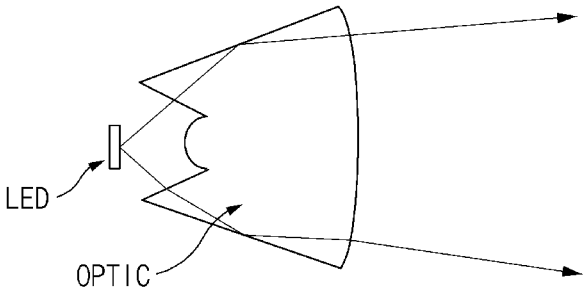

Hereinafter, a lamp fora vehicle and a vehicle including the same according to the present disclosure will be described with reference to the drawings. Hereinafter, exemplary embodiments of the present disclosure will be described in detail with reference to the accompanying drawings so that those with ordinary skill in the art to which the present disclosure pertains may easily carry out the embodiments. However, the present disclosure may be implemented in various different ways and is not limited or restricted by the embodiments described herein.

A part irrelevant to the description will be omitted to clearly describe the present disclosure. Further, the specific descriptions of publicly known related technologies will be omitted when it is determined that the specific descriptions may unnecessarily obscure the subject matter of the present disclosure. In assigning reference numerals to constituent elements of the respective drawings in the present specification, the same or similar constituent elements will be designated by the same or similar reference numerals throughout the specification.

In addition, terms or words used in the specification and the claims should not be interpreted as being limited to a general or dictionary meaning and should be interpreted as a meaning and a concept which conform to the technical spirit of the present disclosure based on a principle that an inventor can appropriately define a concept of a term in order to describe his/her own invention by the best method.

Lamp for Vehicle

Figure 2:
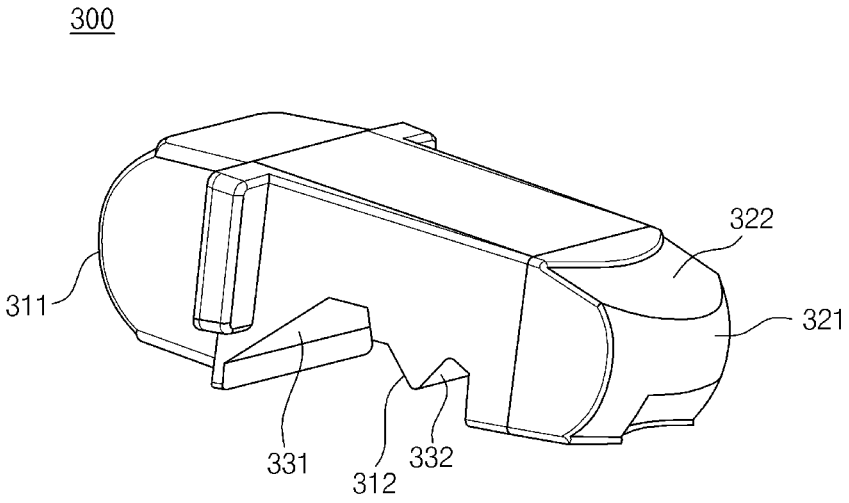
FIG. 2 is a perspective view illustrating a light guide unit of a lamp for a vehicle according to an embodiment of the present disclosure.
Figure 3:
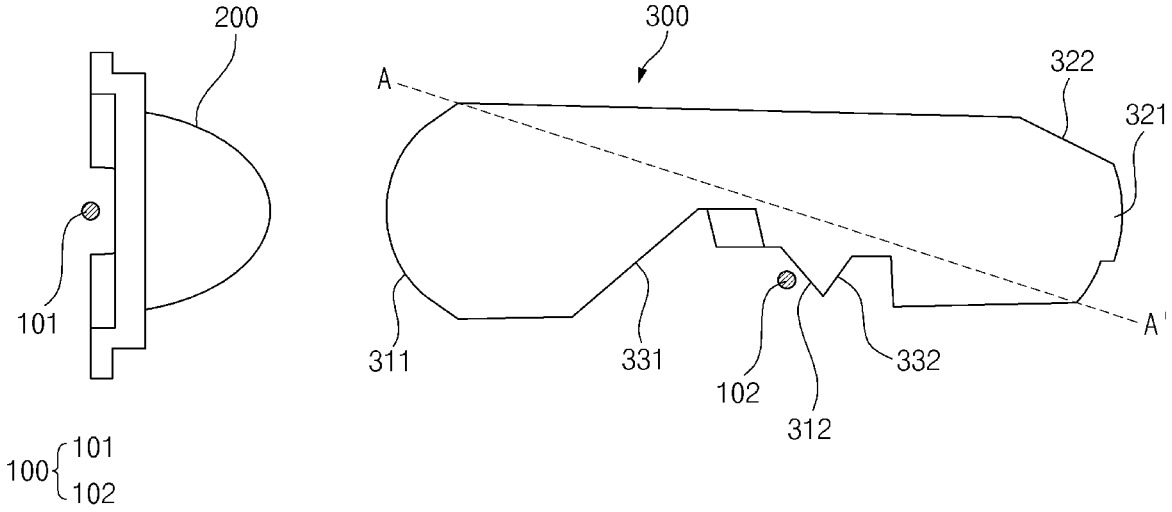
FIG. 3 is a cross-sectional side view illustrating the light guide unit and a light source of the lamp for a vehicle according to the embodiment of the present disclosure.

FIG. 2 is a perspective view illustrating a light guide unit of a lamp for a vehicle according to the embodiment of the present disclosure. FIG. 3 is a cross-sectional side view illustrating the light guide unit and a light source of the lamp for a vehicle according to the embodiment of the present disclosure.

Referring to FIGS. 2 and 3, a lamp for a vehicle (hereinafter, referred to as a 'lamp') according to the present disclosure includes a plurality of light sources 100 and a light guide unit 300. The light source 100 is a device that emits light. For example, the light source 100 may be, but not necessarily limited to, an LED.

The plurality of light sources 100 serves to form two or more types of light distribution patterns. The plurality of light sources 100 of the lamp for a vehicle according to the present disclosure includes a first light source 101 and a second light source 102. The first light source 101 may be disposed rearward of the light guide unit 300 and face a rear portion of the light guide unit 300. The light emitted from the first light source 101 passes through a collimator 200 and enters the light guide unit 300. The collimator 200 may be configured to convert the light emitted from the first light source 101 into parallel light and supply the parallel light to the light guide unit 300. The first light source 101 may be surrounded by the collimator 200. The light emitted from the first light source 101 may pass through the light guide unit 300 and form a first light distribution pattern. The first light distribution pattern may particularly be a low beam pattern.

The second light source 102 may be disposed below the light guide unit 300 and face a lower portion of the light guide unit 300. The light emitted from the second light source 102 may pass through the light guide unit 300 and form a second light distribution pattern. The second light distribution pattern may particularly be a DRL pattern. As described above, the lamp according to the present disclosure may include the light guide unit 300, and the first and second light sources 101 and 102 provided to face the rear and lower portions of the light guide unit 300, respectively, and the first and second light sources 101 and 102 emit light, such that the single lamp may form two types of light distribution patterns.

The light guide unit 300 is disposed at one side of the plurality of light sources 100 as described above. The light guide unit 300 has a recessed region having a shape recessed upward in the lower portion of the light guide unit 300. The light guide unit 300 may be a lens. The light guide unit 300 may be made of a glass or plastic material. Because the light guide unit 300 has a complicated shape, unlike a typical lens, as described below, the light guide unit 300 may be made of a plastic material so that the light guide unit 300 may be easily manufactured.

The light guide unit 300 will be described in more detail. The light guide unit 300 includes a first light entering portion 311 and a second light entering portion 312. The first light entering portion 311 may be provided on a rear surface of the light guide unit 300, and at least a part of the light emitted from the first light source 101 may enter the first light entering portion 311. The second light entering portion 312 may be provided in the recessed region of the light guide unit 300, and at least a part of the light emitted from the second light source 102 may enter the second light entering portion 312. That is, at least a part of the light emitted from the first light source 101 may pass through the first light entering portion 311 and then exit to the outside, thereby forming the first light distribution pattern. At least a part of the light emitted from the second light source 102 may pass through the second light entering portion 312 and then exit to the outside, thereby forming the second light distribution pattern. As described above, according to the lamp according to the present disclosure, the light guide unit 300, which is a single optical system, may include the first light entering portion 311 and the second light entering portion 312, thereby implementing the two types of light distribution patterns. Therefore, it is possible to achieve the function of the lamp and the spatial efficiency and implement the day and night lighting images of the lamp by using the single lamp.

The second light entering portion 312 according to the present disclosure is positioned below a function division plane AA'. The function division plane AA' may mean an imaginary plane that connects an uppermost end of the rear portion of the light guide unit 300 and a lowermost end of the front portion of the light guide unit 300. As described above, the function division plane AA' may be a plane that connects the uppermost end of the rear portion of the light guide unit 300 and the lowermost end of the front portion of the light guide unit 300 and divides the light guide unit 300 in half. The function division plane AA' may be a reference plane based on which the function of forming the first light distribution pattern and the function of forming the second light distribution pattern are distinguished in the lamp according to the present disclosure. This configuration will be described in detail. According to the lamp according to the present disclosure, the second light entering portion 312 is positioned below the function division plane AA', such that the light, which is emitted from the second light source 102 and enters the second light entering portion 312, may form a light distribution pattern different from the light distribution pattern formed by the light emitted from the first light source 101, without interfering with the light, which is emitted from the first light source 101 and enters the first light entering portion 311, in the single light guide unit 300.

Meanwhile, the first light entering portion 311 may be provided in the form of a curved surface convexly protruding toward a position disposed rearward of the light guide unit 300. Particularly, the first light entering portion 311 faces the first light source 101, such that the light emitted from the first light source 101 may enter the first light entering portion 311 while being refracted.

In addition, the second light entering portion 312 may be provided in the recessed region formed in the lower portion of the light guide unit 300 and inclined downward in a direction toward the front side of the light guide unit 300. The second light source 102 may be provided within a width of the second light entering portion 312 in a forward/rearward direction. Therefore, the light entering the second light entering portion 312 may exit the light guide unit 300 to the outside at a predetermined angle.

In addition to the first light entering portion 311 and the second light entering portion 312, the light guide unit 300 of the lamp according to the present disclosure may further include a first shield portion 331, a cut-off portion (not illustrated), a second shield portion 332, a first light exiting portion 321, and a second light exiting portion 322. The respective components will be described in detail below with reference to FIGS. 3 to 5.

Figure 4:
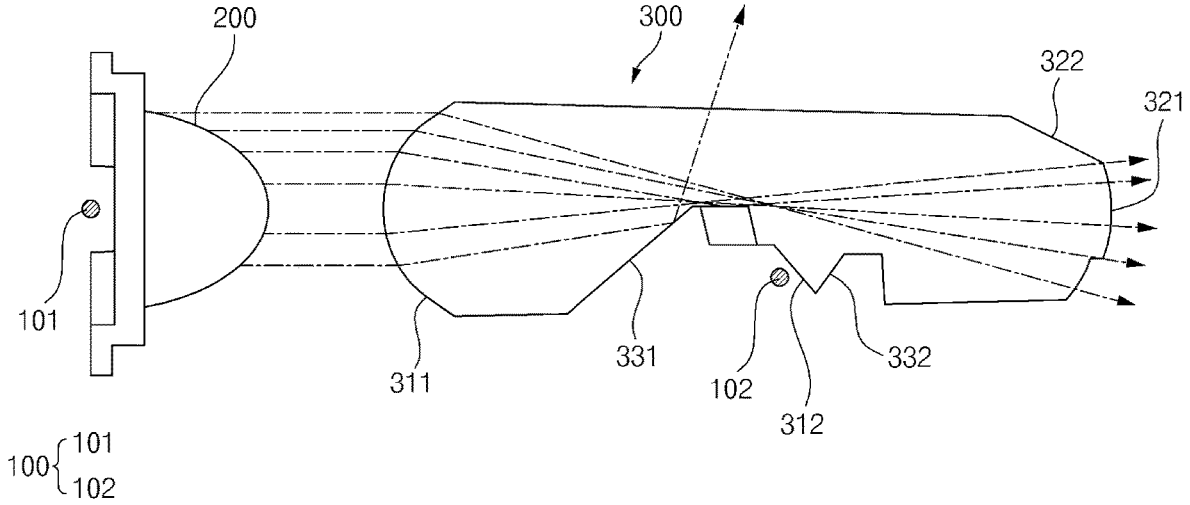
FIG. 4 is a view illustrating a route of light emitted from a first light source of the lamp for a vehicle according to the embodiment of the present disclosure.
Figure 5:
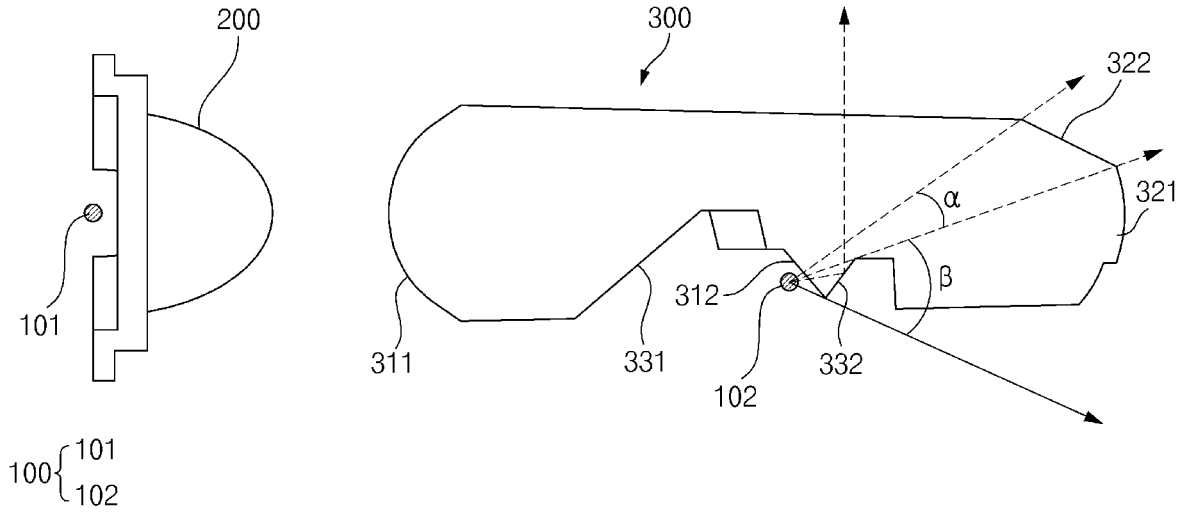
FIG. 5 is a view illustrating a route of light emitted from a second light source of the lamp for a vehicle according to the embodiment of the present disclosure.

FIG. 4 is a view illustrating a route of light emitted from the first light source of the lamp for a vehicle according to the embodiment of the present disclosure. FIG. 5 is a view illustrating a route of light emitted from the second light source of the lamp for a vehicle according to the embodiment of the present disclosure.

First, referring to FIGS. 3 and 4, the first shield portion 331 may be provided in the recessed region of the light guide unit 300 and disposed rearward of the second light entering portion 312. In addition, the first shield portion 331 may be inclined upward in the direction toward the front side of the light guide unit 300. A reflective layer may be formed on one surface of the first shield portion 331, thereby blocking at least a part of the light emitted from the first light source 101. That is, the first shield portion 331 is a region that serves as a shield for blocking a part of the light entering through the first light entering portion 311 in order to form the first light distribution pattern. For example, the first shield portion 331 may be provided in the form of a flat surface. However, the present disclosure is not limited thereto, and the first shield portion 331 may be provided in the form of a curved surface. However, since the first shield portion 331 is inclined upward in the direction toward the front side, it is possible to prevent the light, which reaches the first shield portion 331 and is reflected, from exiting the first light exiting portion 321 to be described below. For example, a light-reflecting material layer may be formed on the first shield portion 331. However, a separate light-reflecting material layer may not be formed on the first shield portion 331.

The cut-off portion may extend from the first shield portion 331 toward the front side of the light guide unit 300. The cut-off portion may be a surface formed in parallel with an optical axis of the first light exiting portion 321 to be described below. The cut-off portion may have a shape stepped in a leftward/rightward direction. The cut-off portion may form a cut-off line on the first light distribution pattern formed by the first light source 101. Therefore, the cut-off line may be formed to correspond to a shape of the cut-off portion. Furthermore, a reflective layer may be formed on an upper portion of the cut-off portion. Therefore, the light reaching the upper portion of the cut-off portion is reflected and directed toward the first light exiting portion 321 to be described below, which makes it possible to minimize a loss of light and improve luminous efficiency.

Next, referring to FIGS. 3 and 5, the second shield portion 332 may be provided in the recessed region of the light guide unit 300 and extend in the direction from the second light entering portion 312 to the front side of the light guide unit 300. The second shield portion 332 is also a region that serves as a shield for blocking a part of the entering light in order to form the second light distribution pattern. The second shield portion 332 may be inclined upward in the direction toward the front side of the light guide unit 300. A reflective layer may be formed on one surface of the second shield portion 332, thereby blocking at least a part the light emitted from the second light source 102. As described above, the second shield portion 332 extends in the direction from the second light entering portion 312 to the front side of the light guide unit 300 and is inclined upward. Therefore, it is possible to prevent the light entering the second light entering portion 312 from exiting to the first light exiting portion 321. The light may exit the second light exiting portion 322 and form the second light distribution pattern. For example, a light-reflecting material layer may be formed on the second shield portion 332. However, a separate light-reflecting material layer may not be formed on the second shield portion 332.

In addition, the second shield portion 332 may be positioned below the function division plane AA'. That is, the second light entering portion 312 configured to form the second light distribution pattern is positioned below the function division plane AA', and the second shield portion 332 is also positioned below the function division plane AA'. Therefore, the light emitted from the first light source 101 and the light emitted from the second light source 102 may form different light distribution patterns without interfering with each other in the single light guide unit 300.

Next, the first light exiting portion 321 and the second light exiting portion 322 will be described in detail.

The first light exiting portion 321 may be provided on the front portion of the light guide unit 300, and at least a part of the light entering through the first light entering portion 311 may exit the first light exiting portion 321. The second light exiting portion 322 may be provided on the front portion of the light guide unit 300, and at least a part of the light entering through the second light entering portion 312 may exit the second light exiting portion 322. As described above, since the first light exiting portion 321 and the second light exiting portion 322 are separately provided on the light guide unit 300, the single lamp may form the two types of light distribution patterns.

Meanwhile, the first light exiting portion 321 and the second light exiting portion 322 may each have a curved shape convexly protruding toward a position disposed forward of the light guide unit 300. The first light exiting portion 321 and the second light exiting portion 322 may have aspherical lens shapes having different radii of curvature in order to respectively form the first light distribution pattern and the second light distribution pattern.

In addition, the second light exiting portion 322 may be provided above the first light exiting portion 321. The second light distribution pattern may be formed at an upper side of the lamp by the second light exiting portion 322. The first light distribution pattern may be formed below the second light distribution pattern by the first light exiting portion 321.

However, a lowermost end of the second light exiting portion 322 may be coincident with an imaginary plane extending from the second light source 102 and an uppermost end of the second shield portion 332 or positioned below the imaginary plane extending from the second light source 102 and the uppermost end of the second shield portion 332. In this case, the lowermost end of the second light exiting portion 322 may mean an interface at which the second light exiting portion 322 meets the first light exiting portion 321 having a different radius of curvature from the second light exiting portion 322.

Referring to FIG. 5, the light emitted from the second light source 102 may enter the second light entering portion 312, the light within a light exiting angle $\alpha$ may exit the second light exiting portion 322, and the light within a light blocking angle $\beta$ may be blocked while being totally reflected by the second shield portion 332. Therefore, the imaginary plane extending from the second light source 102 and the uppermost end of the second shield portion 332 may be a plane through which the light beam, which propagates through a lowermost side among the light beams exiting the second light exiting portion 322 within the light exiting angle $\alpha$, passes without being blocked by the second shield portion 332. Since the lowermost end of the second light exiting portion 322 is coincident with or positioned below the imaginary plane extending from the second light source 102 and the uppermost end of the second shield portion 332, the light emitted from the second light source 102 may exit the second light exiting portion 322 and form the second light distribution pattern without exiting the first light exiting portion 321.

Vehicle

A vehicle according to the present disclosure includes a lamp for a vehicle (hereinafter, referred to as a 'lamp'). The lamp may include: the plurality of light sources 100 configured to form two or more types of light distribution patterns; and the light guide unit 300 provided at one side of the plurality of light sources 100 and having the recessed region having the shape recessed upward in the lower portion of the light guide unit 300.

The light source 100 includes: the first light source 101 disposed rearward of the light guide unit 300 and configured to face the rear portion of the light guide unit 300; and the second light source 102 disposed below the light guide unit 300 and configured to face the lower portion of the light guide unit 300. The light guide unit 300 includes: the first light entering portion 311 provided on the rear portion of the light guide unit 300 and configured such that at least a part of the light emitted from the first light source 101 enters the first light entering portion 311; and the second light entering portion 312 provided in the recessed region of the light guide unit 300 and configured such that at least a part of the light emitted from the second light source 102 enters the second light entering portion 312. The second light entering portion 312 may be positioned below the function division plane which is the imaginary cross-section connecting the uppermost end of the rear portion of the light guide unit 300 and the lowermost end of the front portion of the light guide unit 300. The vehicle according to the present disclosure may implement both the low beam pattern and the DRL pattern by using the single optical system. The vehicle according to the present disclosure may also discriminate the front design of the vehicle and improve the identity by unifying the day and night lighting images of the lamp.

Meanwhile, the above-mentioned description of the lamp according to the present disclosure may also be equally applied to the vehicle according to the present disclosure.

The present disclosure has been described with reference to the limited embodiments and the drawings, but the present disclosure is not limited thereto. The present disclosure may be carried out in various forms by those skilled in the art, to which the present disclosure pertains, within the technical spirit of the present disclosure and the scope equivalent to the appended claims.

What is claimed is:

1. A lamp for a vehicle, the lamp comprising:

a plurality of light sources configured to form two or more types of light distribution patterns, the plurality of light sources comprising at least a first light source and a second light source; and a light guide unit disposed at one side of the plurality of light sources, the light guide unit comprising:

a rear portion, wherein the first light source is disposed rearward of the light guide unit and configured to face the rear portion of the light guide unit;

a first light entering portion provided on the rear portion of the light guide unit and configured such that at least a part of light emitted from the first light source enters the first light entering portion;

a lower portion, wherein the second light source is disposed below the light guide unit and configured to face the lower portion of the light guide unit;

a recessed region having a shape recessed upward in the lower portion of the light guide unit; and a second light entering portion provided in the recessed region of the light guide unit and configured such that at least a part of light emitted from the second light source enters the second light entering portion, wherein the second light entering portion is positioned below a function division plane which is an imaginary plane connecting an uppermost end of the rear portion of the light guide unit and a lowermost end of a front portion of the light guide unit.

2. The lamp of claim 1, wherein at least a part of the light emitted from the first light source passes through the first light entering portion, exits to the outside, and then forms a first light distribution pattern, and at least a part of the light emitted from the second light source passes through the second light entering portion, exits to the outside, and then forms a second light distribution pattern.

3. The lamp of claim 2, wherein the first light distribution pattern is a low beam pattern, and the second light distribution pattern is a DRL pattern.

4. The lamp of claim 1, wherein the first light entering portion is provided in the form of a curved surface convexly protruding toward a position disposed rearward of the light guide unit.

5. The lamp of claim 1, wherein the light guide unit further comprises:

a first shield portion provided in the recessed region of the light guide unit and disposed rearward of the second light entering portion; and a cut-off portion extending in a direction from the first shield portion toward a front side of the light guide unit.

6. The lamp of claim 5, wherein the first shield portion is inclined upward in a direction toward the front side of the light guide unit, and a reflective layer is formed on one surface of the first shield portion and blocks at least a part of the light emitted from the first light source.

7. The lamp of claim 1, wherein the second light entering portion is inclined downward in a direction toward a front side of the light guide unit.

8. The lamp of claim 7, wherein the second light source is provided within a width of the second light entering portion in a forward/rearward direction.

9. The lamp of claim 1, wherein the light guide unit is provided in the recessed region of the light guide unit and further comprises a second shield portion extending in a direction from the second light entering portion toward a front side of the light guide unit.

10. The lamp of claim 9, wherein the second shield portion is positioned below the function division plane.

11. The lamp of claim 9, wherein the second shield portion is inclined upward in a direction toward the front side of the light guide unit, and a reflective layer is formed on one surface of the second shield portion and blocks at least a part of the light emitted from the second light source.

12. The lamp of claim 1, wherein the light guide unit further comprises:

a first light exiting portion provided on a front portion of the light guide unit and configured such that at least a part of the light entering through the first light entering portion exits the first light exiting portion; and a second light exiting portion provided on the front portion of the light guide unit and configured such that at least a part of the light entering through the second light entering portion exits the second light exiting portion.

13. The lamp of claim 12, wherein the first light exiting portion and the second light exiting portion have curved shapes convexly protruding toward a front side of the light guide unit and have aspherical lens shapes having different radii of curvature.

14. The lamp of claim 12, wherein the second light exiting portion is disposed above the first light exiting portion.

15. The lamp of claim 12, wherein a lowermost end of the second light exiting portion is coincident with an imaginary plane extending from the second light source and an uppermost end of the second shield portion or positioned below the imaginary plane extending from the second light source and the uppermost end of the second shield portion.

16. A vehicle comprising:

a lamp for a vehicle, wherein the lamp for a vehicle comprises:

a plurality of light sources configured to form two or more types of light distribution patterns, the plurality of light sources comprising at least a first light source and a second light source; and a light guide unit disposed at one side of the plurality of light sources, the light guide unit comprising:

a rear portion, wherein the first light source is disposed rearward of the light guide unit and configured to face the rear portion of the light guide unit;

a first light entering portion provided on the rear portion of the light guide unit and configured such that at least a part of light emitted from the first light source enters the first light entering portion;

a lower portion, wherein the second light source is disposed below the light guide unit and configured to face the lower portion of the light guide unit;

a recessed region having a shape recessed upward in the lower portion of the light guide unit; and a second light entering portion provided in the recessed region of the light guide unit and configured such that at least a part of light emitted from the second light source enters the second light entering portion, wherein the second light entering portion is positioned below a function division plane which is an imaginary plane connecting an uppermost end of the rear portion of the light guide unit and a lowermost end of a front portion of the light guide unit.

* * * * *